United States Patent [19]

Wilson

[11] 4,218,057

[45] Aug. 19, 1980

[54] ARM EXERCISER FOR RUNNERS

[76] Inventor: Bradford W. Wilson, 1642-A Coriander, Costa Mesa, Calif. 92626

[21] Appl. No.: 938,095

[22] Filed: Aug. 29, 1978

[51] Int. Cl.[3] ..... A63B 21/00

[52] U.S. Cl. ..... 272/117

[58] Field of Search ..... 272/119, 68, 117, 116, 272/143, 67, 122, 123, 124; 273/84 R, 81 A

[56] References Cited

U.S. PATENT DOCUMENTS

| | | | |
|---|---|---|---|
| 897,201 | 8/1908 | Gannon | 273/84 |
| 2,509,810 | 5/1950 | Core | 272/122 |
| 3,371,930 | 3/1968 | Shiga | 272/124 |
| 3,964,340 | 6/1976 | Antonio et al. | 272/68 X |

*Primary Examiner*—Richard C. Pinkham
*Assistant Examiner*—William R. Browne
*Attorney, Agent, or Firm*—Gordon L. Peterson

[57] ABSTRACT

An arm exerciser for runners comprising a hand grip having a peripheral wall, an end wall and a hand grip passage. A tube is received within the hand grip. A weight comprising metal is provided within the tube, and the outer end of the tube is closed.

6 Claims, 4 Drawing Figures

ARM EXERCISER FOR RUNNERS

BACKGROUND OF THE INVENTION

Running has become a popular activity, not only in competitive athletics, but also among members of the general public who wish to maintain a degree of physical fitness. To increase the intensity of the exercise obtained from running, it is known to provide weights on the ankles and wrists of the runner.

One problem which is experienced, particularly by distance runners, is arm fatigue. In fact, arm fatigue which has caused runners to hold their arms at their sides in lieu of the usual cocked position is held by some to be a reason for hastening exhaustion of the runner. The conventional wrist weights are attached by a strap, and wrist weights of this type can irritate the wrists of the runner.

SUMMARY OF THE INVENTION

This invention provides for increasing the strength of the arms of the runner by providing an arm exerciser which is carried in the hands of the runner and which does not irritate the runner's wrists. This device, not only exercises the arms of the runner, but also adds a weight penalty to increase the intensity of the exercise obtained from running. The arm exerciser is hand held in such a way that a smaller weight can provide greater resistance than a larger prior art weight.

The arm exerciser can advantageously include an elongated enclosure having a peripheral wall, at least a region of which is of a size to be manually grasped by the runner. The enclosure has a cavity therein, and a weight comprising metal is provided in the cavity to make the exerciser materially heavier. Typically, the weight has a greater density than the enclosure.

In use, a runner carries one of the exercisers in each hand. The weight of the exerciser can vary depending upon the needs of each runner.

Characteristically, a runner swings his arms back and forth with each stride. To facilitate manual gripping of the exerciser and to reduce the likelihood that the exerciser will be thrown or dropped while running, the enclosure can advantageously include a hand grip. For example, a motorcycle handlebar hand grip can be used. Such a hand grip has axially spaced radial projections which make the device easy to grasp and reduce the likelihood that it will slip out of the runner's hand. As an additional precaution, a safety cord can be attached to the exerciser and looped around the wrist of the runner so that the exerciser cannot be thrown by the runner during the normal pumping motion of the arms. This is of particular importance with this device because it may weigh several pounds and, if it were inadvertently thrown, it could cause significant injury to an onlooker.

The enclosure also preferably includes a tube received and retained within the passage of the hand grip. The tube may be rigid or it may take the form of a second hand grip force fit and/or glued within the other hand grip. The weight is provided within the tube. The outer end of the tube is preferably closed to confine the weight and for cosmetic purposes.

The end of the tube can project beyond the hand grip if desired. Similarly, the position of the weight within the tube can be selected to provide the desired amount of torque on the hands and wrists of the runner. The weight can be of different sizes to provide both relatively heavy and relatively light arm exercisers.

The hand grip has an end wall with an aperture extending through the end wall. The safety cord can advantageously extend through the aperture of the end wall and form a loop on the exterior of the hand grip. Although the cord can be attached to the remainder of the exerciser in different ways, this can be simply and inexpensively accomplished by forming a knot on the cord within the enclosure of such a size as to prevent the cord from being withdrawn from the hand grip through the aperture in the end wall. A washer can be provided between the knot and the end wall to add bearing strength and additional rigidity to the end wall and to the cord-to-end wall attachment.

The weight can be any relatively heavy substance and may be, for example, a metal bar, a heavy putty-like mass or a plurality of weight elements, such as shot. Weight elements of a size to pass through the aperture in the end wall of the hand grip can be used because the cord fills up the aperture sufficiently to prevent the weight elements from passing through the aperture.

The invention can best be understood by reference to the following description taken in connection with the accompanying illustrative drawing.

DESCRIPTION OF THE PREFERRED EMBODIMENTS

Figure 1:
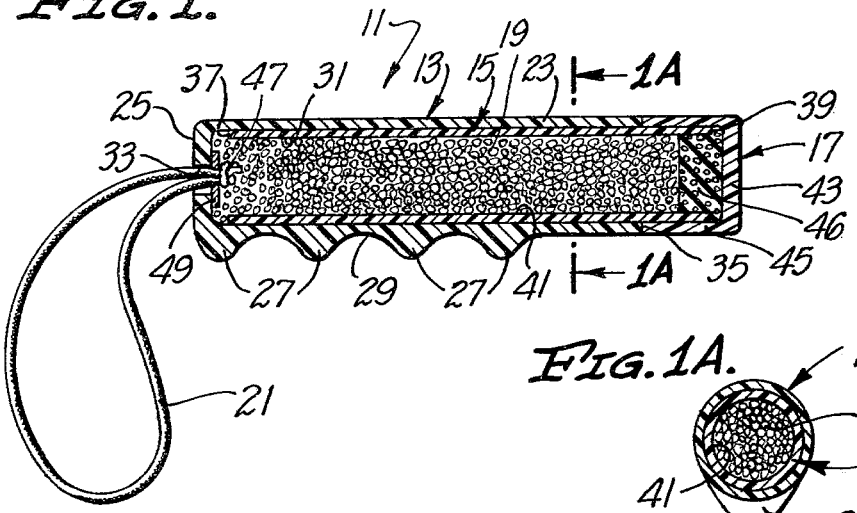
FIG. 1 is an axial sectional view of one form of arm exerciser constructed in accordance with the teachings of this invention.
Figure 1A:
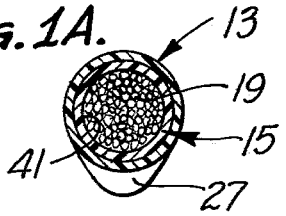
FIG. 1*a* is a sectional view taken along line 1*a*—1*a* of FIG. 1.

FIG. 1 shows an arm exerciser 11 which generally includes a hand grip 13, tube 15, a closure 17, a weight 19 and a safety cord 21. In the embodiment illustrated, the hand grip 13, the tube 15 and the closure 17 form an enclosure for the weight 19.

The hand grip 13 may be a standard motorcycle handlebar hand grip. As such, the hand grip 13 is constructed of a resilient plastic material and includes a peripheral wall 23 and an end wall 25. The peripheral wall 23 is generally cylindrical, except for radial projections 27, which are axially spaced by circumferentially extending grooves 29. The peripheral wall 23 is sized to be manually grapsed with the fingers of the user encircling the peripheral wall and extending, respectively, through the grooves 29. The hand grip 13 has a cylindrical hand grip passage 31, and the end wall completely encloses one end of the passage 31, except for an aperture 33 formed in the end wall. The peripheral wall 23 terminates in an outer end 35.

The tube 15, in the embodiment illustrated, is a rigid tube of plastic material, such as polyvinyl chloride. The tube 15 has an inner end 37, an outer end 39 and a cylindrical axially extending tube passage 41 extending completely through the tube. The tube 15 is received within the hand grip passage 31 and retained therein by a force fit and/or an adhesive. In this embodiment, the inner end 37 lies closely adjacent the end wall 25 and the opposite end portion of the tube projects beyond the outer end 35 and lies outside of the hand grip 13.

Although the closure 17 can take different forms, in the embodiment illustrated, the closure is in the form of a cap which includes an end wall 43 and an annular flange 45 which surrounds the outer end portion of the tube 15. The closure 17 is attached to the tube 15 by an adhesive and/or a force fit. The closure 17 is preferably constructed of a rigid plastic material, such as polyvinyl chloride.

The weight 19 in this embodiment is in the form of a plurality of weight elements. For example, the weight elements may be shot, nail heads or other small members of a suitable metal, such as steel. A pad or cushion 46 of resilient material, such as foam rubber, is compressed between the end wall 43 and the weight elements to minimize or eliminate rattling of the weight elements.

The cord 21 is an elongated flexible element of nylon or other suitable material. The opposite ends of the cord are tied to form a knot 47 which lies just inside the hand grip 13 adjacent the end wall 25. Thus, the cord 21 is formed into a loop, and a major portion of the loop lies outside of the hand grip 13. The diameter or cross-sectional area of the cord is selected so that a double thickness of the cord will substantially completely fill or close the aperture 33. The weight elements of the weight 19 are sufficiently small so that they will pass through the aperture 33. However, the cord fills up the aperture sufficiently so as to substantially prevent the weight elements from passing out of the hand grip 13 through the aperture 33.

The inner end of the cord 21 is retained within the hand grip 13 by the knot 47 which is too large to pass out through the aperture 33 in the end wall 25. To increase the strength of this attachment, a washer 49 is sandwiched between the knot 47 and the end wall 25. The washer 49 is preferably constructed of a rigid material, such as metal, and it lends rigidity and bearing strength to the end wall immediately around the aperture 33. This reduces the likelihood that the knot 47 can be forcibly removed from the hand grip by passing through the aperture 33. Thus, the end wall 25, the knot 47 and the washer 49 cooperate to attach the cord 21 to the hand grip 13.

In use, the hand of the user is inserted through the loop formed by the cord 21, and then the hand grip 13 is manually grasped. One of the arm exercisers 11 is provided for each hand of the runner. With the arm exerciser 11 gripped in this fashion, the normal arm pumping action of the runner's arms is made more difficult by virtue of the weight of the arm exerciser 11. This strengthens the arms of the runner and increases the intensity of the exercise by adding a weight penalty to the runner. The safety cord 21 prevents the arm exerciser 11 from being inadvertently released or thrown by the runner. Of course, the weight of the exerciser 11 may vary depending upon the requirements of each individual runner. For example, the arm exerciser may weigh from one to five pounds. The vast majority of the weight of the exerciser 11 is provided by the weight 19 which is preferably made in whole or in part of metal and which has a much greater density than any of the other components of the exerciser.

Figure 2:
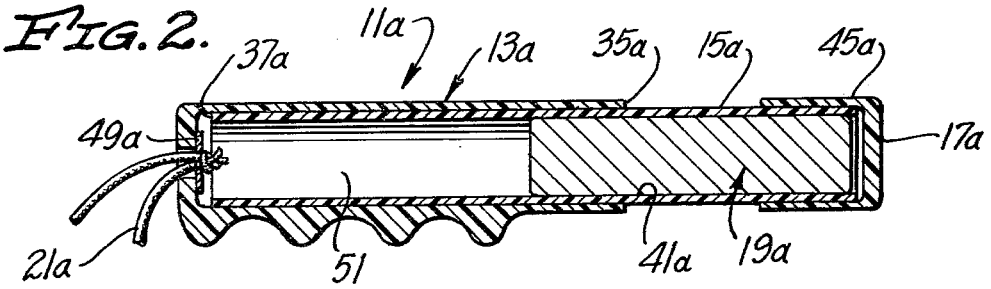
FIG. 2 is an axial sectional view of a second form of arm exerciser constructed in accordance with the teachings of this invention.

FIG. 2 shows an arm exerciser **11*a* which is identical to the arm exerciser 11 in all respects not shown or described herein. Portions of the arm exerciser 11*a* corresponding to portions of the arm exerciser 11** are designated by corresponding reference numerals followed by the letter "a."

The primary differences between the arm exercisers 11 and **11*a* is that, in the latter, the tube 15*a* is longer and projects a greater distance out of the hand grip 13*a*, the weight 19*a* is in the form of an elongated steel rod, a portion 51 of the tube passage 41*a* between the inner end 37*a* and the weight 19*a* is void space, and the pad 46 is eliminated. Also, the outer end 35*a* is spaced a greater distance from the end of the flange 45*a* of the closure 17*a*. In this embodiment, the exerciser 11*a* is longer than the exerciser 11, and a considerable portion of the weight 19*a* lies outside of the hand grip 13*a* and beyond the outer end 35*a* of the hand grip. Thus, the exerciser 11*a* provides greater torque on the hands and wrists of the runner because of the displacement of the weight 19*a* outwardly of the hand grip 13*a*. The arm exerciser 11*a* can be used in the same manner as described above for the arm exerciser 11**.

Figure 3:
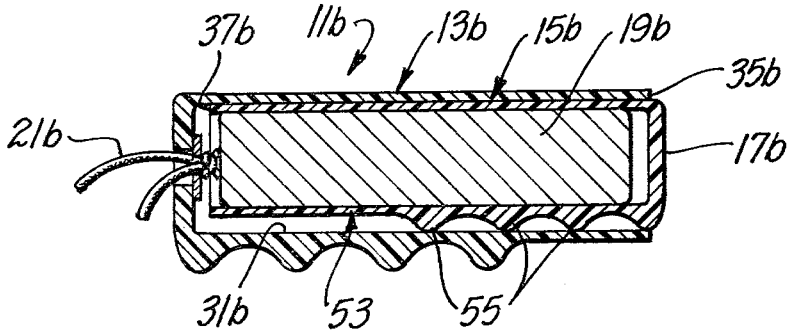
FIG. 3 is an axial sectional view of a third form of arm exerciser constructed in accordance with the teachings of this invention.

FIG. 3 shows an arm exerciser **11*b* which is identical to the arm exerciser 11 in all respects not shown or described herein. Portions of the arm exerciser 11*b* corresponding to portions of the arm exerciser 11** are designated by corresponding reference numerals followed by the letter "b."

The primary differences between the arm exerciser 11 and the arm exerciser **11*b* are that the tube 15*b* and the closure 17*b* are in the form of a second hand grip 53. More specifically, the tube 15*b* forms the peripheral wall of the hand grip 53, and the closure 17*b* forms the end wall of the hand grip. The hand grip 53 may be a standard handlebar type hand grip constructed of resilient plastic material and sized to be force fit within the passage 31*b*. An adhesive may be used in lieu of, or in addition to, the force fit. The hand grip 53 has the usual radial projections 55, and these tend to space portions of the tube 15*b* from portions of the wall of the passage 31*b*. The hand grip 53 projects only slightly from the outer end 35*b*, and may lie completely within the hand grip passage 31*b*, if desired. The weight 19*b* in this embodiment is a steel rod, and there is no pad 46. The arm exerciser 11*b* is used in the same manner as described above for the arm exerciser 11**.

Although exemplary embodiments of the invention have been shown and described, many changes, modifications and substitutions may be made by one having ordinary skill in the art without necessarily departing from the spirit and scope of this invention.

I claim:

1. An arm exerciser for runners comprising:

an elongated enclosure;

said enclosure including a tube and a hand grip having a peripheral wall and an end wall, said tube being received within said hand grip, said end wall having an aperture therein at least a region of the peripheral wall adjacent said end wall being of a size to be manually grasped;

said enclosure having a cavity therein;

a weight comprising metal in said cavity to make the exerciser materially heavier, said weight having a greater density than the enclosure;

a cord with at least a region thereof formed into a loop, said cord extending through said aperture of said end wall; and means for attaching the cord to the enclosure, said attaching means including said end wall and means on said cord and within said enclosure for cooperating with said end wall.

2. An arm exerciser as defined in claim 1 wherein said aperture communicates with said cavity, said weight includes a plurality of weight elements, at least some of said weight elements being sufficiently small to pass through said aperture, and said cord filling said aperture sufficiently to substantially prevent said weight elements from passing out of said enclosure through said aperture.

3. An arm exerciser as defined in claim 1 wherein said attaching means includes a washer within said enclosure, said washer having an opening therein, said cooperating means includes said cord being tied into a knot, said washer being sandwiched between said knot and said end wall, and said knot being too large to pass through said opening in said washer.

4. An arm exerciser for runners comprising:

a hand grip including a peripheral wall and an end wall, said hand grip having a hand grip passage therein opening at an end of the hand grip opposite said end wall;

a tube having a tube passage therein and inner and outer ends;

said tube being received and retained in said hand grip passage with said inner end being in said hand grip passage;

a weight comprising metal in said tube passage to make the exerciser materially heavier;

closure means for closing the outer end of said tube; and said outer end being out of said hand grip passage whereby the tube projects beyond the hand grip, said weight includes a plurality of weight elements, said hand grip being constructed of a resilient material and having a plurality of axially spaced radial projections on the exterior thereof to facilitate manual grasping of the hand grip, said tube being constructed of a rigid plastic material, said end wall having an aperture therein, said exerciser including a cord extending through said aperture with at least a portion of said cord lying outside of said hand grip and defining a loop sized to slip over the hand of the user, and means on said cord within said hand grip for cooperating with said end wall to prevent the cord from being withdrawn from the hand grip through said aperture.

5. An arm exerciser as defined in claim 4 wherein at least a portion of said weight lies in the portion of said tube which is outside the hand grip.

6. An arm exerciser as defined in claim 5 including a nonmetallic filler material in said tube passage between the closure means and said weight.

* * * * *